US010184295B2

(12) United States Patent
Marek

(10) Patent No.: US 10,184,295 B2
(45) Date of Patent: Jan. 22, 2019

(54) MACHINE LEVELING ASSEMBLY AND METHOD

(71) Applicant: Caterpillar Inc., Peoria, IL (US)

(72) Inventor: John P. Marek, Sugar Grove, IL (US)

(73) Assignee: Caterpillar Inc., Deerfield, IL (US)

( * ) Notice: Subject to any disclaimer, the term of this patent is extended or adjusted under 35 U.S.C. 154(b) by 955 days.

(21) Appl. No.: 14/505,250

(22) Filed: Oct. 2, 2014

(65) Prior Publication Data

US 2016/0097238 A1 Apr. 7, 2016

(51) Int. Cl.

| | |
|---|---|
| ***E21B 7/02*** | (2006.01) |
| ***B66C 23/80*** | (2006.01) |
| ***B66C 23/78*** | (2006.01) |
| ***E02F 5/20*** | (2006.01) |
| ***E02F 9/08*** | (2006.01) |
| ***E02F 9/22*** | (2006.01) |

(52) U.S. Cl.

CPC ..... *E21B 7/024* (2013.01); *B66C 23/80* (2013.01); *E02F 5/20* (2013.01); *E02F 9/085* (2013.01); *E02F 9/2257* (2013.01); *B66C 23/78* (2013.01); *E21B 7/02* (2013.01); *E21B 7/022* (2013.01)

(58) Field of Classification Search

CPC .... B60S 9/10; B60S 9/12; E21B 7/022; E21B 7/024; B66C 23/78; B66C 23/80

USPC ..... 254/423

See application file for complete search history.

(56) References Cited

U.S. PATENT DOCUMENTS 3,625,483 A * 12/1971 Stoner ..... B60S 9/12 254/423
3,917,307 A * 11/1975 Shoebridge ..... B60G 17/005 280/104
4,109,733 A * 8/1978 Dummer ..... E21B 7/022 173/189

(Continued)

FOREIGN PATENT DOCUMENTS

DE 2753259 A1 * 6/1978 ..... B66C 23/80
WO WO 85/04918 A1 11/1985

OTHER PUBLICATIONS

Atlas Copco, "Atlas Copco Blasthole Drills: DM25-SP series," 4 pp., Jan. 2013.

(Continued)

*Primary Examiner* — Christopher M Koehler
*Assistant Examiner* — Seahee Yoon
(74) *Attorney, Agent, or Firm* — Leydig, Voit & Mayer, Ltd.

(57) ABSTRACT

A machine comprising a frame including a front-right portion, a front-left portion, a rear-right portion, and a rear-left portion. The machine includes a first jack coupled with the front-right portion for raising or lowering the front-right portion, a second jack coupled with the front-left portion for raising or lowering the front-left portion, a third jack coupled with the rear-right portion for raising or lowering the rear-right portion, and a fourth jack coupled with the rear-left portion for raising or lowering the rear-left portion. The machine includes a front jack leveling system operatively coupled with the first jack and the second jack. The front jack leveling system controls the first jack and the second jack such that a first movement of the first jack in a first direction corresponds to a second movement of the second jack in a second direction that is opposite from the first direction.

16 Claims, 6 Drawing Sheets

(56) References Cited

U.S. PATENT DOCUMENTS 4,116,409 A 9/1978 Barber et al.
4,142,710 A * 3/1979 Okuda ..... B66C 23/80 212/304
4,165,861 A * 8/1979 Hanser ..... B60S 9/12 254/423
4,273,244 A * 6/1981 Jensen ..... B66C 23/80 180/125
4,679,489 A * 7/1987 Jasinski ..... E21B 7/022 175/24
4,746,133 A * 5/1988 Hanser ..... B60S 9/12 180/41
5,176,391 A 1/1993 Schneider et al.
5,188,379 A * 2/1993 Krause ..... B60S 9/12 254/423
6,129,226 A * 10/2000 Donovan ..... B66C 23/54 212/238
6,315,079 B1 * 11/2001 Berends ..... B66F 3/46 187/203
6,634,451 B2 * 10/2003 Sakakiyama ..... B60K 23/0808 180/197
7,025,178 B2 * 4/2006 Wengelski ..... B60S 9/12 187/244
7,182,163 B1 * 2/2007 Gipson ..... B66C 23/80 180/8.1
7,325,634 B2 * 2/2008 Law ..... E21B 7/024 175/220
7,461,712 B2 * 12/2008 Law ..... E21B 7/024 180/41
7,577,557 B2 * 8/2009 Kondo ..... G06F 17/5022 703/14
7,815,200 B2 * 10/2010 Bakshi ..... B60S 9/12 280/6.153
8,757,637 B2 * 6/2014 Tiedge ..... B60S 9/12 280/6.153
8,965,636 B2 * 2/2015 Stacy, II ..... B66C 23/80 254/423
9,114,782 B2 * 8/2015 Warr ..... E21B 7/024
9,223,302 B2 * 12/2015 Maurer ..... H02P 29/00
9,284,167 B2 * 3/2016 Stacy, II ..... B66C 23/78
9,725,882 B2 * 8/2017 Lee ..... E02F 9/2228
2006/0043718 A1 * 3/2006 Mayer ..... E02F 9/085 280/763.1
2006/0082079 A1 * 4/2006 Eichhorn ..... B60S 9/12 280/6.155
2006/0226612 A1 * 10/2006 Smith ..... B60P 3/00 280/6.153
2007/0056727 A1 * 3/2007 Newman ..... E21B 41/00 166/250.01
2008/0087469 A1 * 4/2008 Law ..... E21B 7/024 175/40
2011/0112727 A1 * 5/2011 Stacy ..... B66C 23/80 701/49
2011/0112728 A1 * 5/2011 Stacy, II ..... B66C 23/78 701/49

OTHER PUBLICATIONS

Atlas Copco, "Atlas Copco Blasthole Drills: Pit Viper 311," 4 pp., Jan. 2013.

* cited by examiner

MACHINE LEVELING ASSEMBLY AND METHOD

TECHNICAL FIELD

This patent disclosure relates generally to mining and construction equipment and, more particularly, to drilling equipment.

BACKGROUND

Construction and mining equipment and machinery often operates in terrain that can vary in pitch and work surface grades. In such terrain, it is often desirable to level a machine with respect to a reference plane, such as the horizon or an angled plane. Traditionally, leveling of machines, for example, mining equipment such as rotary drills, is accomplished using four leveling jacks connected to the main frame near the frame's corners. An operator will often achieve side-to-side leveling using, e.g., only the left and right rear jacks, and then use the left and right front leveling jacks to complete front-to-back leveling. During some leveling adjustments, however, the frame and other machine components can be exposed to unwanted stress and fatigue due to frame torsion and other forces. For example, if the rear leveling jacks are used to achieve side-to-side leveling, as discussed above, damaging frame twisting can occur and, in extreme cases, one or more of the leveling jacks can be lifted off the work surface.

Some previous attempts to address this problem use three leveling jacks instead of four, so that the frame is free to pivot about the single front leveling jack when side-to-side leveling is conducted by the rear leveling jacks. Such systems, however, may provide decreased stability as opposed to systems having a frame with four leveling jacks.

SUMMARY

The disclosure describes, in one aspect, a machine comprising a frame including a front-right portion, a front-left portion, a rear-right portion, and a rear-left portion. The machine includes a first jack coupled with the front-right portion for raising or lowering the front-right portion, a second jack coupled with the front-left portion for raising or lowering the front-left portion, a third jack coupled with the rear-right portion for raising or lowering the rear-right portion, and a fourth jack coupled with the rear-left portion for raising or lowering the rear-left portion. The machine also includes a front jack leveling system operatively coupled with the first jack and the second jack. The front jack leveling system controls the first jack and the second jack such that a first movement of the first jack in a first direction corresponds to a second movement of the second jack in a second direction that is opposite from the first direction.

In another aspect, the disclosure describes a leveling assembly for a machine including a frame. The leveling assembly includes a first jack operatively coupled with the front-right portion for selectively raising or lowering a front-right portion of the frame, a second jack operatively coupled with the front-left portion for selectively raising or lowering a front-left portion of the frame, a third jack operatively coupled with the rear-right portion for selectively raising or lowering a rear-right portion of the frame, and a fourth jack operatively coupled with the rear-left portion for selectively raising or lowering a rear-left portion of the frame. The leveling assembly also includes a front jack leveling system operatively coupled with the first jack and the second jack. The front jack leveling system is also configured to control the first jack and the second jack such that a first movement of the first jack in a first direction corresponds to a second movement by the second jack in a second direction that is opposite from the first direction.

In yet another aspect, the disclosure describes a method of leveling a frame of a machine. The method includes providing a first jack operatively coupled with a front-right portion of the frame for selectively raising or lowering the front-right portion, a second jack operatively coupled with a front-left portion of the frame for selectively raising or lowering the front-left portion, a third jack operatively coupled with a rear-right portion of the frame for selectively raising or lowering the rear-right portion, and a fourth jack operatively coupled with a rear-left portion of the frame for selectively raising or lowering the rear-left portion. The method also includes coupling a front jack leveling system with the first jack and the second jack such that the front jack leveling system is configured to control the first jack and the second jack. The method also includes controlling the first jack and the second jack such that a first movement of the first jack in a first direction corresponds to a second movement of the second jack in a second direction that is opposite from the first direction.

DETAILED DESCRIPTION

Figure 1:
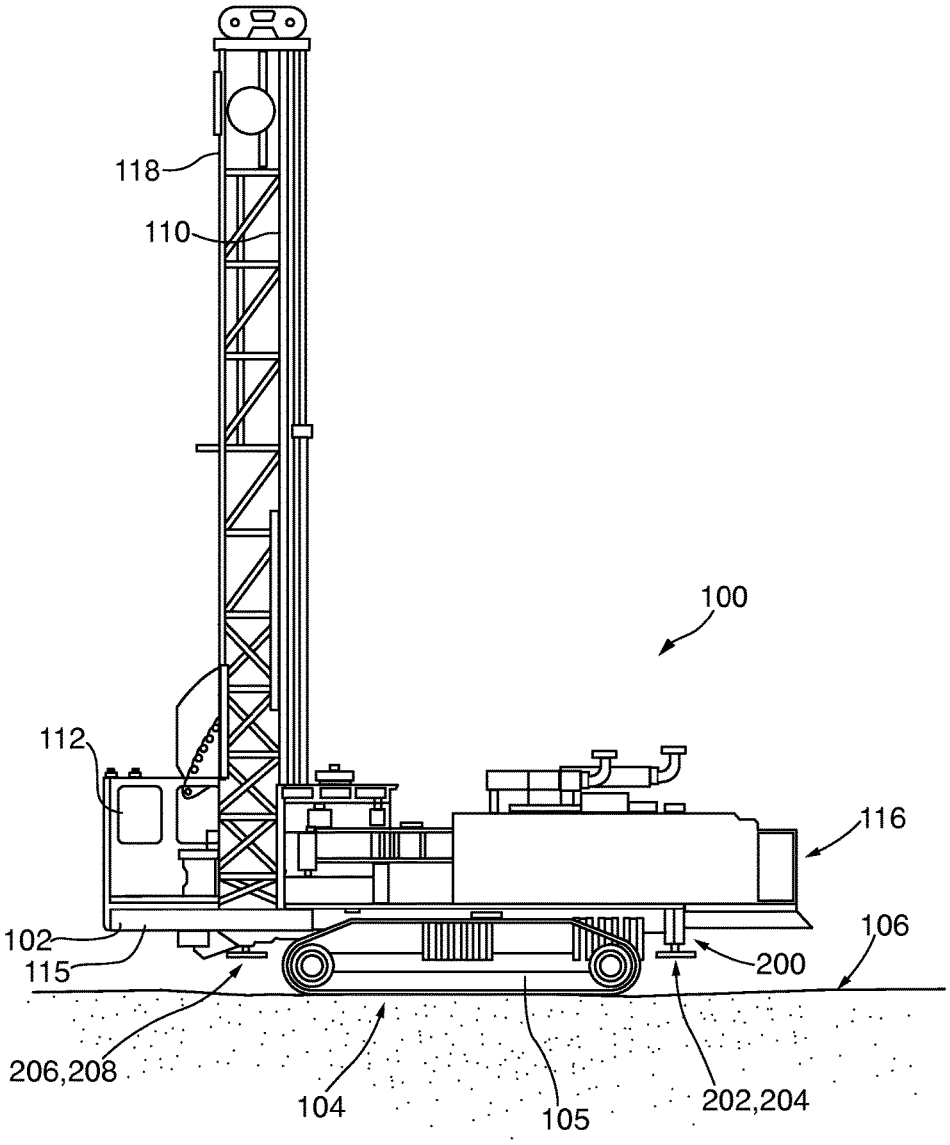
FIG. 1 is a right side view of a machine with a leveling assembly in accordance with the disclosure.

This disclosure relates to an apparatus and methods for leveling a machine that avoids subjecting a machine frame to undue stress and fatigue due to torsion effects. FIG. 1 illustrates an example of a machine 100 featuring a leveling assembly that will be described in further detail below. Although the machine 100 illustrated in FIG. 1 is a rotary drill machine, it is contemplated that the features of this disclosure can be suitable for use in various other mining and construction applications. The machine 100 includes a frame 102 supported on a track assembly 104 that holds the frame above a work surface 106. The track assembly 104 includes at least two tracks 105 that can propel the machine 100 between locations. The machine 100 has a cab 112 attached to a rear portion 114 of the frame 102, which is opposite the front portion 116 of the frame. The cab 112 can house machine 100 controls for an operator to control the machine's movements and functionality. The frame 102 can also have a right side 115 and a left side 117. The machine 100 includes a mast 118 that can be pivotally connected to the frame 102, and a drill 110 that is housed within the mast. The drill 110 can be used to create holes in the work surface 106 for mining or other purposes. In some applications, it can be desirable to align the drill 110 so as to create a substantially perpendicular hole with respect to the work surface 106. In other applications, it can be desirable to create a hole at a specific angle to the work surface 106. In either type of application, it can be desirable to rotate and thereby level the frame 102 such that the drill 110 can create a hole at the desired angle into the work surface 106.

Figure 2:
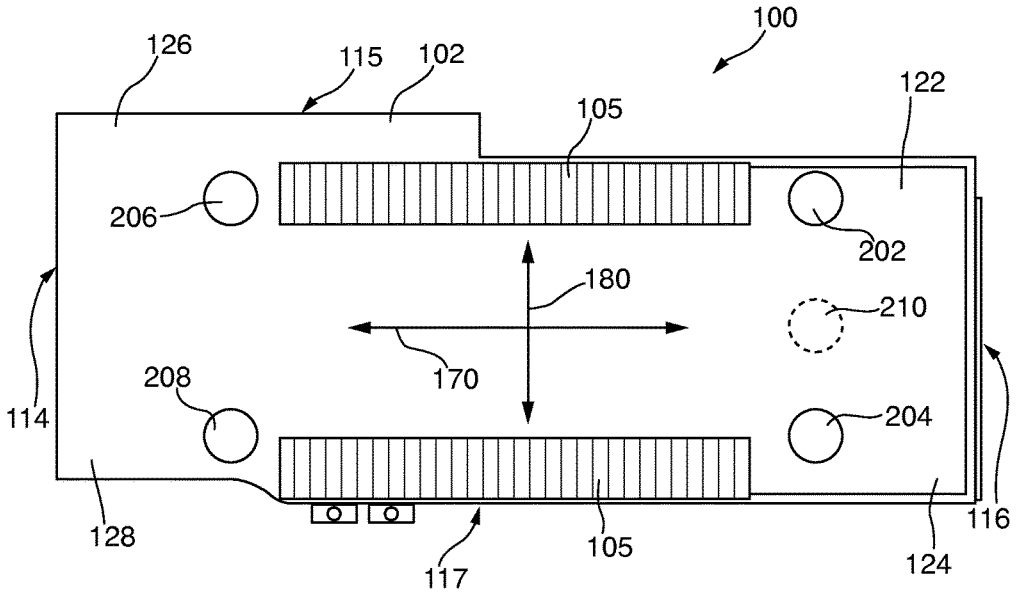
FIG. 2 is a bottom view of the machine of FIG. 1.

Leveling of the frame 102 can be achieved using a leveling assembly 200 that includes leveling jacks. The machine 100 includes four leveling jacks; specifically, a first jack 202, a second jack 204, a third jack 206, and a fourth jack 208. Though all four jacks are not visible in FIG. 1, FIG. 2 illustrates a schematic representation of the bottom of the machine frame 102 that includes all four jacks. The frame 102 can be substantially divided into four portions; namely, a front-right portion 122, a front-left portion 124, a rear-right portion 126, and a rear-left portion 128. The respective right and left portions can be separated generally by a front-to-back axis 170, and the respective front and rear portions can be separated generally by a side-to-side axis 180. FIG. 2 shows the front-to-back axis 170 disposed substantially centered between right and left sides of the frame, and the side-to-side axis 180 disposed substantially centered between front and rear portions of the frame. It is contemplated, however, that these axes 170, 180 may not be exactly centered on the frame depending on the specific machine's geometry. Additionally, it is to be understood that the axes 170, 180 are included in FIG. 2 for illustrative purposes only. In the illustrated embodiment, the first jack 202 is operatively coupled with the front-right portion 122, the second jack 204 is operatively coupled with the front-left portion, the third jack 206 is operatively coupled to the rear-right portion 126, and the fourth jack 208 is operatively coupled to the rear-left portion 128.

Figure 3:
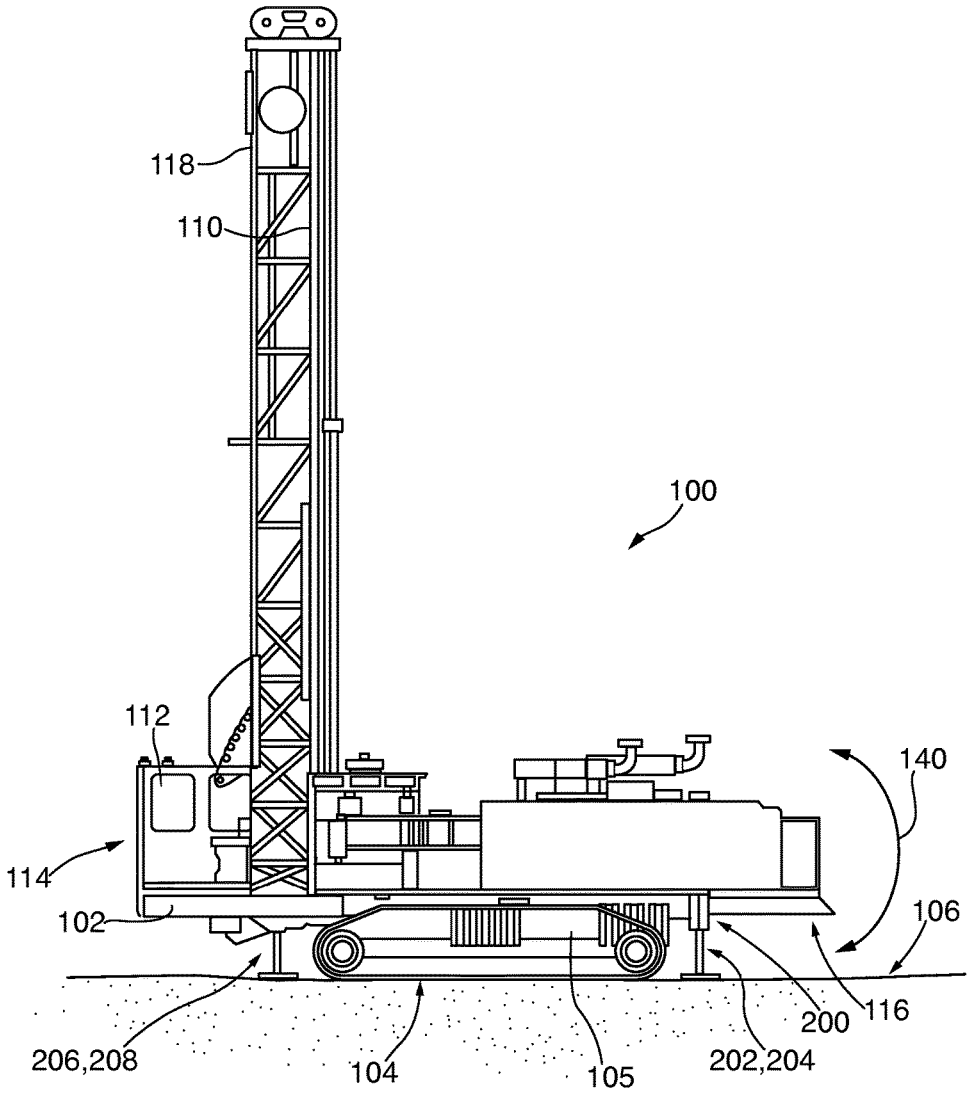
FIG. 3 is a right side view of the machine of FIG. 1 with leveling jacks extended.

In order to level the frame 102, each respective leveling jack can be extended and retracted to selectively raise and lower their respective portions of the frame. Specifically, the first jack 202 can extend and retract to raise and lower the front-right portion 122, the second jack 204 can extend and retract to raise and lower the front-left portion 124, the third jack 206 can extend and retract to raise and lower the rear-right portion 126, and the fourth jack 208 can extend and retract to raise and lower the rear-left portion 128. FIG. 1 illustrates the machine 100 with all four leveling jacks 202, 204, 206, 208 retracted and, therefore, not in contact with the work surface 106. FIG. 3 shows the machine with all four leveling jacks 202, 204, 206, and 208 in an extended position making contact with the work surface 106. Depending on the desired orientation of the frame 102 with respect to the work surface 106 or another suitable reference plane, the machine 100 operator or an automated control system can manipulate the leveling jacks to positions anywhere between and including extended and retracted positions as needed for frame orientation. In the case of a rotary drill as illustrated herein, it may be desirable to orient the frame 102 using the leveling jacks such that the drill 110 has the proper angle of attack with respect to the work surface 106.

Figure 4:
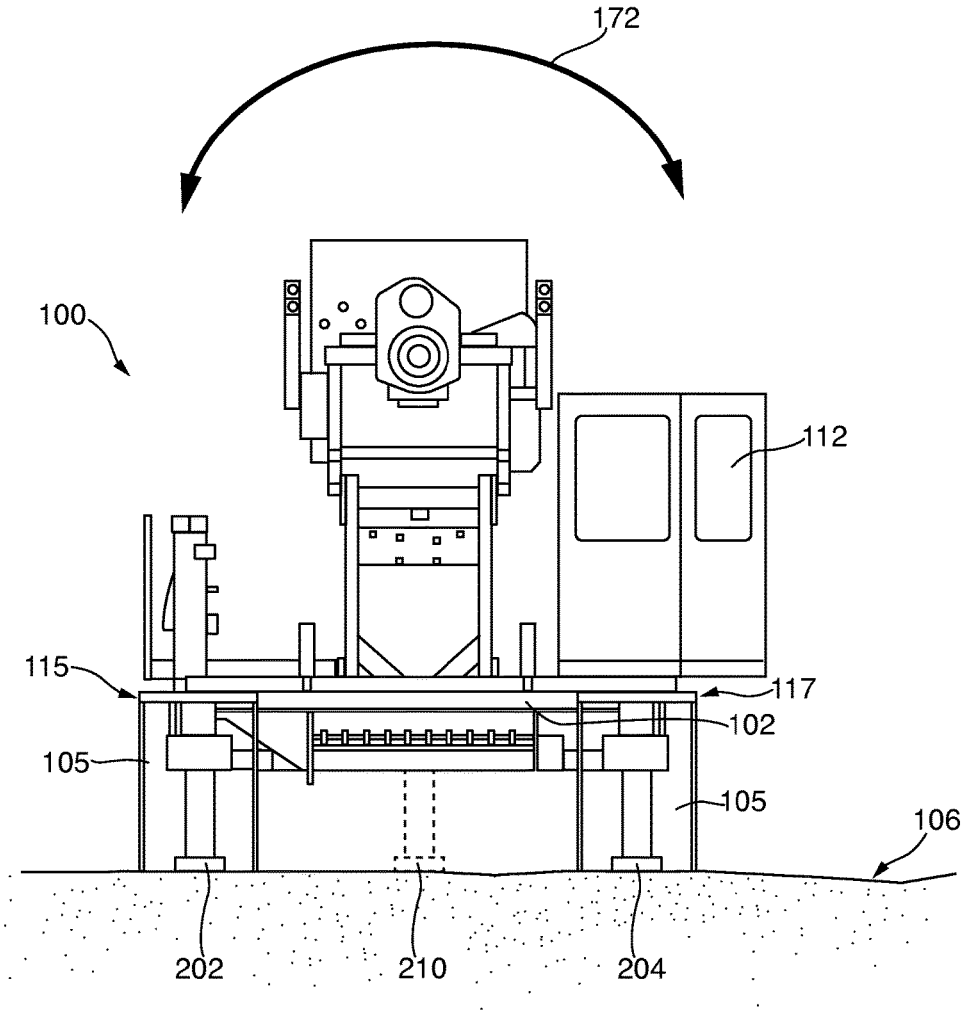
FIG. 4 is a front view of the machine of FIG. 1.

As discussed above, the leveling jacks 202, 204, 206, 208 can cause the frame 102 to pivot substantially about a side-to-side axis 180 such that the front portion 116 of the frame moves up or down as the rear portion 114 of the frame pitches down or up, respectively. Such pivoting about the side-to-side axis 180 can be implemented to establish the pitch of the frame 102 as desired for a particularly application. A pitch arc 140 illustrated in FIG. 3 shows the general arc in which the frame 102 can pivot about the side-to-side axis 180. Similarly, the leveling jacks 202, 204, 206, 208 can cause the frame 102 to pivot substantially about a front-to-back axis 170 such that a right side 115 of the frame moves up or down as a left side 117 moves down or up, respectively. Such pivoting about the front-to-back axis 170 can be implement to establish the roll of the frame 102 as desired for a particular application. A roll arc 172 illustrated in FIG. 4 shows the general arc in which the frame 102 can pivot about the front-to-back axis 170. Although not directly shown in the figures, it is contemplated that the leveling jacks 202, 204, 206, 208 of the leveling assembly 200 could pivot the frame about substantially any axis by simultaneously operating combinations of leveling jacks, restricted only by the length at to which each jack can extend and retract. This disclosure describes only to the front-to-back axis 170 and side-to-side axis 180 in detail for simplification of explanation.

Figure 5:
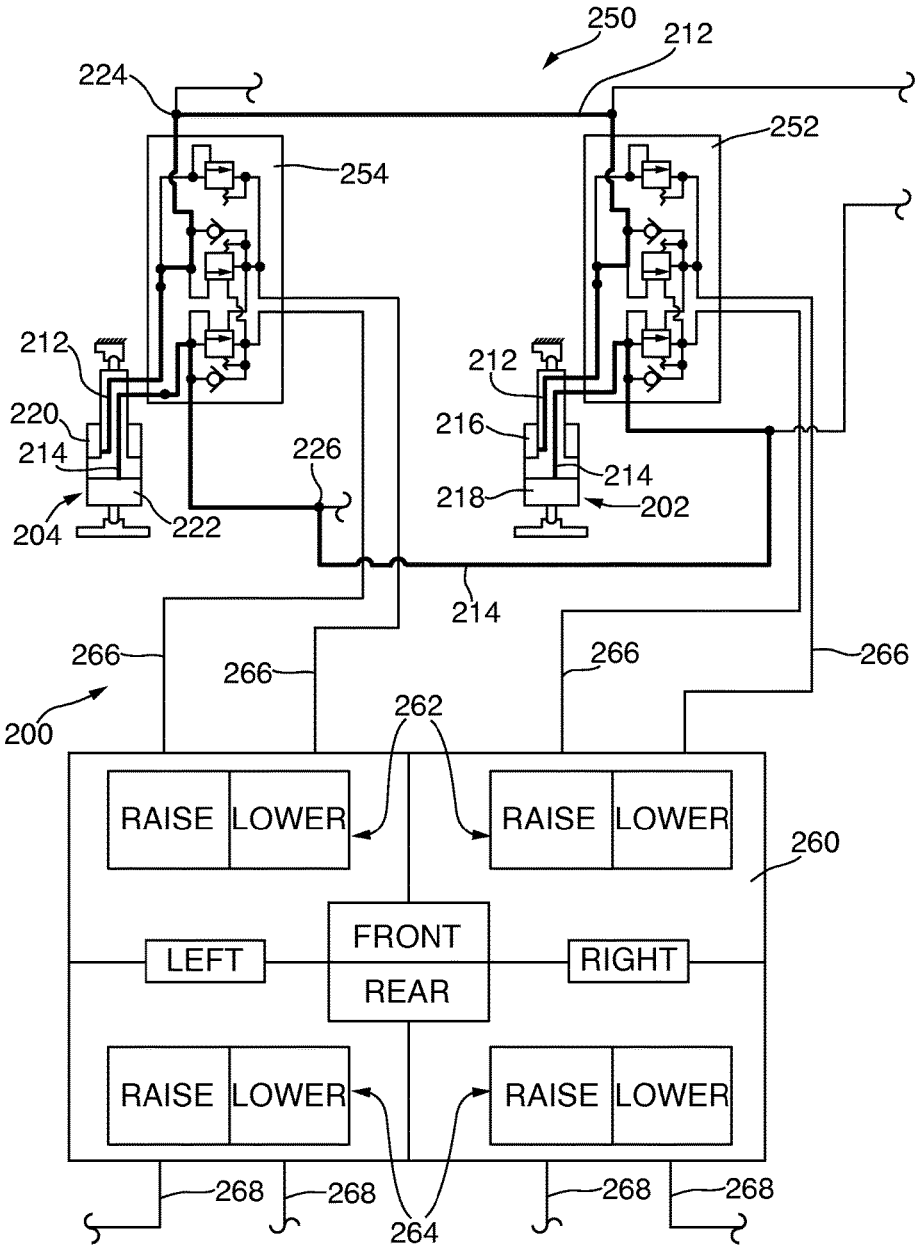
FIG. 5 is a partial schematic illustration of a leveling assembly in accordance with the disclosure.

As illustrated in FIG. 5, the leveling assembly 200 can include a front jack leveling system 250. The front jack leveling system 250 can be operatively coupled with the first jack 202 and the second jack 204. The front jack leveling system 250 can be configured to control the first jack 202 and the second jack 204 such that a first movement of the first jack in a first direction corresponds to a second movement by the second jack in a second direction that is opposite from the first direction. For example, in certain embodiments and under certain machine conditions, when the first jack 202 moves down (first movement in a first direction), to raise the front-right portion 122 of the frame 102, the second jack 204 can correspondingly move up (second movement in a second direction), opposite the first jack. By corresponding such opposite movements between the first jack 202 and the second jack 204, the frame 102 can pivot substantially about the front-to-back axis 170. In other words, when the first jack 202 and the second jack 204 move in corresponding opposite directions, the first and second jacks are pivoting the frame 102 as if simulating a single front jack disposed substantially between the first and second jacks. Such as simulated single front jack 210, for example, is shown in dashed lines in FIGS. 2 and 4. It should be understood that the simulated single front jack 210 is shown merely for illustrative purposes and does actually a feature of the disclosed machine. In certain machine conditions, however, movement by the first jack 202 in a first direction can correspond to movement by the second jack 204 in substantially the same direction, such that the movements of the first jack and the second jack are directly and positively correlated.

In the embodiment illustrated in FIG. 5, the front jack leveling system 250 is a hydraulic system that uses hydraulic fluid to control the first and second jacks 202, 204, which are hydraulic jacks. Although FIG. 5 shows a hydraulic system with hydraulic jacks, it is contemplated that the leveling jacks 202, 204, 206, 208 can be controlled by mechanical systems, electronic systems, motorized systems, or any other suitable type of leveling systems to control the jacks. The front jack leveling assembly 250 shown in FIG. 5 includes a first valve system 252 and a second valve system 254 associated with the first jack 202 and the second jack 204, respectively. The first valve system 252 and the second valve system 254 can include a system of hydraulic lines and valves to direct hydraulic fluid to extend and retract the first and second jacks 202, 204 as desired for particular frame leveling movements.

The first and second jacks 202, 204 can include hydraulic chambers associated with the first valve system 252 and the second valve system 254, respectively. Specifically, the first jack 202 can include an upper hydraulic chamber 216 and a lower hydraulic chamber 218, and the second jack 204 can include an upper hydraulic chamber 220 and a lower hydraulic chamber 222. Hydraulic fluid can be pumped in and out of the hydraulic chambers as desired to extend and retract the first and second jacks 202, 204. For example, hydraulic fluid can be pumped into the upper hydraulic chamber 216 of the first jack 202 to extend the first jack and raise the front-right portion 122 of the frame 102, and hydraulic fluid can be pumped into the lower hydraulic chamber 218 of the first jack 202 to retract the first jack. It is contemplated, however, that other hydraulic configurations could succeed in extending and retracting the leveling jacks.

The front jack leveling system 250 also includes an upper hydraulic line 212 and a lower hydraulic line 214 that can run at least partially through the first and second valve systems 252, 254 and form fluid communication between the first and second jacks 202, 204. The hydraulic lines 212, 214 can be formed form a single, dedicated hose or other conduit, or can be made up of various conduit or hose segments partitioned with valves or other junctions. In the illustrated embodiment, the upper hydraulic line 212 forms fluid communication between the upper hydraulic chamber 216 of the first jack 202 and the upper hydraulic chamber 220 of the second jack 204, and the lower hydraulic line 214 forms fluid communication between the lower hydraulic chamber 218 of the first jack 202 and the lower hydraulic chamber 222 of the second jack 204. Additionally, the front jack leveling system 250 can include at least one upper front valve 224 disposed along the upper hydraulic line 212 that can open and close to selectively open and close fluid communication between the upper hydraulic chambers 216, 220 of the first and second jacks 202, 204. Similarly, at least one lower front valve 226 can be disposed along the lower hydraulic line 214 that can open and close to selectively open and close fluid communication between the lower hydraulic chambers 218, 222 of the first and second jacks 202, 204. Although only a single upper front valve 224 and a single lower front valve 226 is shown in FIG. 5, it is contemplated that additional valves can be used in other embodiments. Additionally, it is contemplated that a single valve can be used to effectively open and close fluid communication along both the upper hydraulic line 212 and the lower hydraulic line 214.

When the upper and lower front valves 224, 226 are open to allow fluid communication between the upper hydraulic chambers 216, 220 of the respective first and second jacks 202, 204 and between the lower hydraulic chambers 218, 222 of the respective first and second jacks, the movements of the first and second jacks to extend and retract can correspond to one another such that the frame 102 can pivot evenly about the front-to-back axis 170. For example, when the first jack 202 retracts, at least a portion of the hydraulic fluid in the upper hydraulic chamber 216 of the first jack is pushed through the upper hydraulic line 212 and into the upper hydraulic chamber 220 of the second jack 204 as the second jack is allowed to simultaneously extend. At the same time, as the second jack 204 extends, at least a portion of the hydraulic fluid in the lower hydraulic chamber 222 of the second jack is pushed through the lower hydraulic line 214 and into the lower hydraulic chamber 218 of the first jack 202 as the first jack simultaneously retracts. Similarly, when the first jack 202 extends, hydraulic fluid is allowed to move from the lower hydraulic chamber 218 of the first jack into the lower hydraulic chamber 222 of the second jack as the second jack simultaneously retracts, and hydraulic fluid is allowed to move from the upper hydraulic chamber 220 of the second jack to the upper hydraulic chamber 216 of the first jack. Thus, when the upper and lower front valves 224, 226 are open to allow fluid communication between the respective upper and lower hydraulic chambers of the first and second jack as described, a first movement by the first jack 202 in a first direction corresponds to a second movement by the second jack 204 in a second direction that is opposite to the first direction. Such corresponding movements by the first and second jacks 202, 204 can allow the front end 116 of the frame 102 to pivot about the front-to-back axis 170 as if only a single jack was present centrally located along the front-to-back axis. Though not shown in the figures, it is contemplated that the leveling assembly can additionally include a rear jack leveling system substantially identical to the front jack leveling system 250 for controlling extension and retraction of the third and fourth jacks 206, 208.

As also shown schematically in FIG. 5, the machine 100 can include a control unit 260 that is configured to control the leveling assembly 200. Specifically, the control unit 260 can control at least the leveling jacks 202, 204, 206, 208 as well as the front jack leveling system 250. The control unit 260 includes front controls 262 and rear controls 264. The front controls 262 are configured to raise and lower the front-right portion 122 and front-left portion 124 of the frame 102 by raising and lowering the first and second jacks 202, 204, respectively. In some embodiments, it is contemplated that a single set of front controls 262 can raise or lower both the first jack 202 and the second jack 204 simultaneously. In such embodiments, the first and second jacks 202, 204 may be used solely to set the pitch of the frame 102. In the embodiment illustrated in FIG. 5, however, the first and second jacks 202, 204 can be controlled by the front controls 262 either simultaneously to correspond with one another, or independently. The rear controls 264 are configured to raise and lower the rear-right portion 126 and rear-left portion 128 of the frame 102 by raising and lowering the third and fourth jacks 206, 208, respectively. It is contemplated that the control unit 260 is configured to control each of the leveling jacks 202, 204, 206, 208 individually or in any combination of multiple jacks. As schematically illustrated in FIG. 5, front control electric wiring 266 connects the control unit 260 to the front jack leveling system 250; however, wireless communication between the control unit and the front jack leveling system is contemplated in certain embodiments. Although not shown in FIG. 5, the control unit 260 can be connected to the third and fourth jacks 206, 208 through rear control electric wiring 268 or other wireless communication methods.

The control unit 260 can also control, either manually or automatically, the opening and closing of the upper front valve 224 and the lower front valve 226 to open or close fluid communication between the first and second jacks 202, 204 along the upper and lower hydraulic lines 212, 214. In some embodiments, the control unit 260 is configured to automatically open both the upper front valve 224 and the lower front valve 226 whenever the rear controls 264 are activated by an operator or during an automatic leveling procedure, or when either of the third jack 206, the fourth jack 208, or both, are moving. In such an embodiment, whenever the rear controls 264 are active in controlling either the third jack 206, the fourth jack 208, or both the third and fourth jacks, fluid communication exists between the respective upper hydraulic chambers 216, 220 of the first and second jacks 202, 204 and between the respective lower hydraulic chambers 218, 222 of the first and second jacks. Conversely, when the rear controls 264 are not active, i.e., neither the third jack 206 nor the fourth jack 208 are moving, the control unit 260 is configured to automatically close the upper front valve 224 and the lower front valve 226, closing fluid communication between the first and second jacks 202, 204. Thus, when the rear controls 264 are active, the fluid communication between the first and second jacks 202, 204 allows for the front-right 122 and front-left 124 portions of the frame 102 to freely pivot about the front-to-back axis 170. When the rear controls 264 are not acting to extend or contract either the third jack 206 or the fourth jack 208, the first and second jacks 202, 204 can operate in tandem, independent of one another, or in any other suitable manner.

The control unit 260 of this disclosure may be of any conventional design having hardware and software configured to perform the calculations and send and receive appropriate signals to perform the engagement logic. The control unit 260 may include one or more controllers, and may be configured solely to perform the engagement strategy, or to perform the engagement strategy and other processes of the machine 100. The controller unit 260 may be of any suitable construction, however in one example it comprises a digital processor system including a microprocessor circuit having data inputs and control outputs, operating in accordance with computer-readable instructions stored on a computer-readable medium. Typically, the processor will have associated therewith long-term (non-volatile) memory for storing the program instructions, as well as short-term (volatile) memory for storing operands and results during (or resulting from) processing.

The arrangement disclosed herein has universal applicability in various other types of machines. The term "machine" may refer to any machine that performs some type of operation associated with an industry such as mining, construction, farming, transportation, or any other industry known in the art. For example, the machine may be a mining machine, such as a rotary drill, or an earth-moving machine, such as a wheel loader, excavator, dump truck, backhoe, motor grader, material handler or the like. Moreover, an implement may be connected to the machine. Such implements may be utilized for a variety of tasks, including, for example, drilling, loading, compacting, lifting, brushing, and include, for example, drills, buckets, compactors, forked lifting devices, brushes, grapples, cutters, shears, blades, breakers/hammers, augers, and others.

INDUSTRIAL APPLICABILITY

The industrial application of the machine leveling assembly and methods described herein should be readily appreciated from the foregoing discussion. The present disclosure may be applicable to any type of machine with a frame that is leveled using at least four leveling jacks. It may be particularly useful in machines that are used one uneven terrain and when it is desirable to orient the machine frame in a particularly manner.

The disclosure, therefore, may be applicable to many different machines and environments. One exemplary machine suited to the disclosure is rotary drill. Rotary drills are often utilized in mining operations where the terrain upon which the machine rests is uneven. However, in order to align the drill to effectively bore a hole in the work surface, it can be desirable to properly level the frame of the rotary drill machine. Leveling a rotary drill having the features disclosed herein has certain advantages. For example, in some applications, the third and fourth jacks 206, 208 are used to pivot the frame 102 about the front-to-back axis 170 to set the desired roll of the frame 102. In the disclosed machine 100, the first and seconds jacks 202, 204 are controlled as disclosed above such that a movement of the first jack in a first direction corresponds to a second movement of the second jack in an opposite direction, particularly when the third and fourth jacks 206, 208 are being activated. Thus, for example, when the third jack 206 is controlled to raise the rear-right portion 126 of the frame 102, the front-right portion 122 of the frame is free to move without being restricted by the first jack 202. Instead, the front end 116 of the frame 102 can freely pivot about the front-to-back axis 170 and, in the process, avoid excess torsion and twisting forces on the frame that can add to frame stresses and fatigue. The front end 116 of the frame 102 pivots as if only a single, centrally located jack were connected to the front end of the frame. Once the third and fourth jacks 206, 208 have finished adjusting the desired roll of the frame 102, the front jack leveling system 250 can de-couple the first and second jacks 202, 204 so that the first and second jacks no longer make corresponding first and second equal and opposite movements. Thus, a machine featuring the leveling assembly 200 described herein has the advantage of applying less stress to the frame during leveling due to a simulated, centrally located single front jack, while benefiting from the added stability of two jacks at the front end of the frame. Such reduced stresses in the frame can enable the frame to be made from less material, thus increasing efficiency and saving resources.

Figure 6:
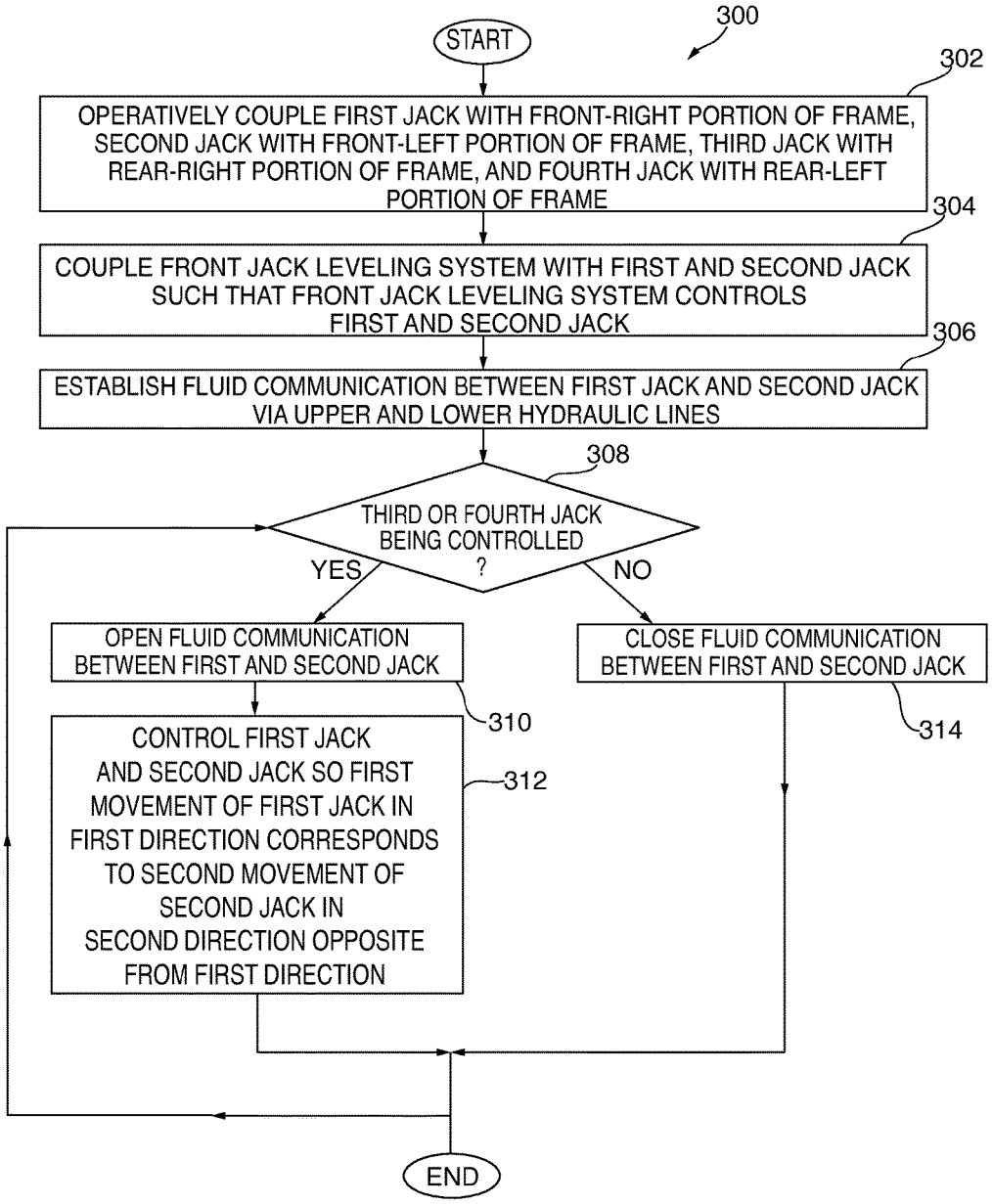
FIG. 6 is a flow chart illustrating an embodiment of a method for leveling a machine in accordance with the disclosure.

In one exemplary embodiment according to the above disclosure, the frame 102 is leveled as illustrated in the flow chart 300 in FIG. 6. At 302, the method comprises operatively coupling a first jack with a front-right portion of the frame for selectively raising or lowering the front-right portion, a second jack with a front-left portion of the frame for selectively raising or lowering the front-left portion, a third jack with a rear-right portion of the frame for selectively raising or lowering the rear-right portion, and a fourth jack with a rear-left portion of the frame for selectively raising or lowering the rear-left portion. At 304, the method includes coupling a front jack leveling system with the first jack and the second jack such that the front jack leveling system is configured to control the first jack and the second jack. At 306, the method can include establishing fluid communication between the first jack and the second jack via an upper hydraulic line and a lower hydraulic line. At 308, the method can include selectively controlling at least one of the third jack or the fourth jack to pivot the frame about a front-to-back axis defined substantially between the rear-right portion of the frame and the rear-left portion of the frame. If at least one of the third or fourth jacks is being controlled or otherwise activated at 308, the method includes opening fluid communication between the first jack and the second jack at 310, and controlling the first jack and the second jack such that a first movement of the first jack in a first direction corresponds to a second movement of the second jack in a second direction that is opposite from the first direction at 312. If neither the third jack nor the fourth jack are being controlled or otherwise activated at 308, the method includes closing fluid communication between the first jack and the second jack at 314.

Further, the methods and assemblies above can be adapted to a large variety of machines. For example, other types of industrial machines, such as backhoe loaders, compactors, feller bunchers, forest machines, industrial loaders, wheel loaders and many other machines can benefit from the methods and systems described.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A machine comprising:

a frame including a front-right portion, a front-left portion, a rear-right portion, and a rear-left portion;

a first jack operatively coupled with the front-right portion for selectively raising or lowering the front-right portion;

a second jack operatively coupled with the front-left portion for selectively raising or lowering the front-left portion;

a third jack operatively coupled with the rear-right portion for selectively raising or lowering the rear-right portion;

a fourth jack operatively coupled with the rear-left portion for selectively raising or lowering the rear-left portion; and a front jack leveling system operatively coupled with the first jack and the second jack and being configured to control the first jack and the second jack such that a first movement of the first jack in a first direction corresponds to a first movement of the second jack in a second direction that is opposite from the first direction;

wherein the front jack leveling systems includes an upper hydraulic line and a lower hydraulic line, each of the upper and lower hydraulic lines forming fluid communication between the first and second jacks and at lest one front valve configured to selectively open or close fluid communication along the upper and lower hydraulic lines between the first jack and the second jack so as to allow fluid movement between the first jack and the second jack during the first movement of the first jack and the first movement of the second jack; and a control unit including front controls activatable for selectively operating each of the first and second jacks, and rear controls activatable for selectively operating each of the third and fourth jacks, wherein the control unit is configured to operate the at least one front valve to open fluid communication between hydraulic chambers of the first and second jacks when the rear controls are moving at least one of the third jack or the fourth jack, and to operate the least on front valve to close fluid communication between the hydraulic chambers of the first and second jacks when the rear controls are not moving the third jack or the fourth jack.

2. The machine of claim 1, wherein the frame pivots substantially about a front-to-back axis defined between the front-right portion and the front-left portion during the first movement of the first jack and the second movement of the second jack.

3. The machine of claim 1, wherein the first movement of the first jack in the first direction corresponds to a first movement by the second jack in the second direction when at least one of the third jack or the fourth jack are moving, and the first movement of the first jack in the first direction does not correspond to the first movement of the second jack in the second direction when neither the third jack nor the fourth jack are moving.

4. The machine of claim 3, wherein the second jack is movable in a direction that is substantially the same as the first direction of the first movement of the first jack when neither the third jack nor the fourth jack are moving.

5. The machine of claim 1, wherein the hydraulic chambers of the first and second jacks include an upper and lower hydraulic chamber for each of the first and second jacks, and wherein the upper hydraulic line forms fluid communication between the upper hydraulic chambers of the first and second jacks, and the lower hydraulic line forms fluid communication between the lower hydraulic chambers of the first and second jacks.

6. The machine of claim 5, wherein the control unit is configured to operate the at least one front valve to open fluid communication between the upper hydraulic chambers of the first and second jacks and between the lower hydraulic chambers of the first and second jacks when the rear controls are moving the at least one of the third jack or the fourth jack, and to operate the at least one front valve to close fluid communication between the upper hydraulic chambers of the first and second jacks and between the lower hydraulic chambers of the first and second jacks when the rear controls are not moving the third jack or the fourth jack.

7. The machine of claim 6, wherein an upper front valve is configured to selectively open or close fluid communication along the upper hydraulic line between the upper hydraulic chambers of the first and second jacks, and a lower front valve is configured to selectively open or close fluid communication along the lower hydraulic line between the lower hydraulic chambers of the first and second jacks.

8. The machine of claim 7, wherein the control unit is configured to open both the upper front valve and the lower front valve when the rear controls are active, and to close both the upper front valve and the lower front valve when the rear controls are not active.

9. The machine of claim 8, further comprising a mast disposed on the frame, the mast housing a rotary drill configured to drill into a work surface below the machine, wherein the control unit is configured to level the rotary drill by selectively rotating the frame substantially about a front-to-back axis defined substantially between the front-right portion and the front-left portion of the frame and rotating the frame substantially about a side-to-side axis defined substantially perpendicular to the longitudinal axis between the front portions of the frame and the rear portions of the frame.

10. A leveling assembly for a machine the leveling assembly comprising:

a first jack;

a second jack;

a third jack;

a fourth jack; and a front jack leveling system operatively coupled with the first jack and the second jack and being configured to control the first jack and the second jack such that a first movement of the first jack in a first direction corresponds to a first movement by the second jack in a second direction that is opposite from the first direction, wherein the front jack leveling systems includes an upper hydraulic line and a lower hydraulic line, each of the upper and lower hydraulic lines forming fluid communication between the first and second jacks and at least one front valve configured to selectively open or close fluid communication along the upper and lower hydraulic lines between the first jack and the second jack so as to allow fluid movement between the first jack and the second jack during the first movement of the first jack and the first movement of the second jack, and a control unit including front controls activatable for selectively operating each of the first and second jacks, and rear controls activatable for selectively operating each of the third and fourth jacks, wherein the control unit is configured to operate the at least one front valve to open fluid communication between hydraulic chambers of the first and second jacks when the rear controls are moving at least one of the third jack or the fourth jack, and to operate the at least one front valve to close fluid communication between the hydraulic chambers of the first and second jacks when the rear controls are not moving the third jack or the fourth jack.

11. The leveling assembly of claim 10, wherein the first, second, third and fourth jacks are connected to a frame having a front-to-back axis, and wherein the frame pivots substantially about the front-to-back axis defined between front-right and front-left portions of the frame during the first movement of the first jack and the first movement of the second jack.

12. The leveling assembly of claim 10, wherein the first movement of the first jack in the first direction corresponds to the first movement of the second jack in the second direction when at least one of the third jack or the fourth jack are moving, and the first movement of the first jack in the first direction does not correspond to the first movement by the second jack in the second direction when neither the third jack nor the fourth jack are moving.

13. The leveling assembly of claim 10, wherein the hydraulic chambers of each of the first and second jacks include an upper and lower hydraulic chamber, and wherein the upper hydraulic line forms fluid communication between the upper hydraulic chambers of the first and second jacks, and the lower hydraulic line forms fluid communication between the lower hydraulic chambers of the first and second jacks.

14. The leveling assembly of claim 13, wherein the control unit is configured to operate the at least one front valve to open fluid communication between the upper hydraulic chambers of the first and second jacks and between the lower hydraulic chambers of the first and second jacks when the rear controls are active, and to operate the at least one front valve to close fluid communication between the upper hydraulic chambers of the first and second jacks and between the lower hydraulic chambers of the first and second jacks when the rear controls are not active.

15. The leveling assembly of claim 14, wherein an upper front valve is configured to selectively open or close fluid communication along the upper hydraulic line between the upper hydraulic chambers of the first and second jacks, and a lower front valve is configured to selectively open or close fluid communication along the lower hydraulic line between the lower hydraulic chambers of the first and second front jacks.

16. The leveling assembly of claim 15, wherein the control unit is configured to open both the upper front valve and the lower front valve when the rear controls are active, and to close both the upper front valve and the lower front valve when the rear controls are not active.

* * * * *